United States Patent [19]

Hutton

[11] 3,940,229

[45] Feb. 24, 1976

[54] APPARATUS FOR MANUFACTURING ROUGH FACED BRICKS

[75] Inventor: John R. Hutton, Vancouver, Wash.

[73] Assignee: Columbia Machine, Inc., Vancouver, Wash.

[22] Filed: Feb. 22, 1974

[21] Appl. No.: 445,312

[52] U.S. Cl. ..... 425/436 R; 249/76; 425/304

[51] Int. Cl.[2]. B28B 3/06; B28B 11/08; B28B 13/05

[58] Field of Search ..... 249/72, 73, 74, 75, 76, 249/77, 136, 137, 158, 163; 425/299, 385, 422, 443, 441, 444, 346, 436 R, 184, 199, 218, 220, 262, 291, 292, 296, 304

[56] References Cited

UNITED STATES PATENTS

| | | | |
|---|---|---|---|
| 813,592 | 2/1906 | Schou | 425/385 |
| 996,174 | 6/1911 | Wege | 249/76 |
| 1,204,477 | 11/1916 | Nicholson | 425/304 X |
| 1,480,433 | 1/1924 | Goen | 425/304 X |
| 2,250,697 | 7/1941 | Bassett | 425/422 X |
| 2,359,674 | 10/1944 | Pollock | 425/443 X |
| 2,370,925 | 3/1945 | Wade | 249/136 X |
| 2,735,380 | 2/1956 | Bowes | 425/443 X |
| 3,264,702 | 8/1966 | Clanton | 425/443 X |
| 3,366,368 | 1/1968 | Hibbing | 425/444 X |

*Primary Examiner*—R. J. Shore
*Assistant Examiner*—John S. Brown
*Attorney, Agent, or Firm*—Kolisch, Hartwell, Dickinson & Stuart

[57] ABSTRACT

Apparatus for manufacturing a brick having a roughened side surface including interconnected, upright, side plates defining a mold cavity having generally the shape of a brick to be formed. A bottom plate is shiftable vertically from a position against the lower edges of the side plates to form a bottom for the mold and a position spaced a distance therebelow. A power-operated pusher mounted above the side plates is shiftable downwardly into the region between the side plates for forcing a brick formed in the mold outwardly through the bottom of the mold when the bottom plate is lowered. One of the side plates has a lip projecting substantially normally outwardly therefrom into the path along which a side of a brick will be moved as it is forced from the mold. This lip scrapes a side of the brick to produce a roughened surface thereon.

7 Claims, 6 Drawing Figures

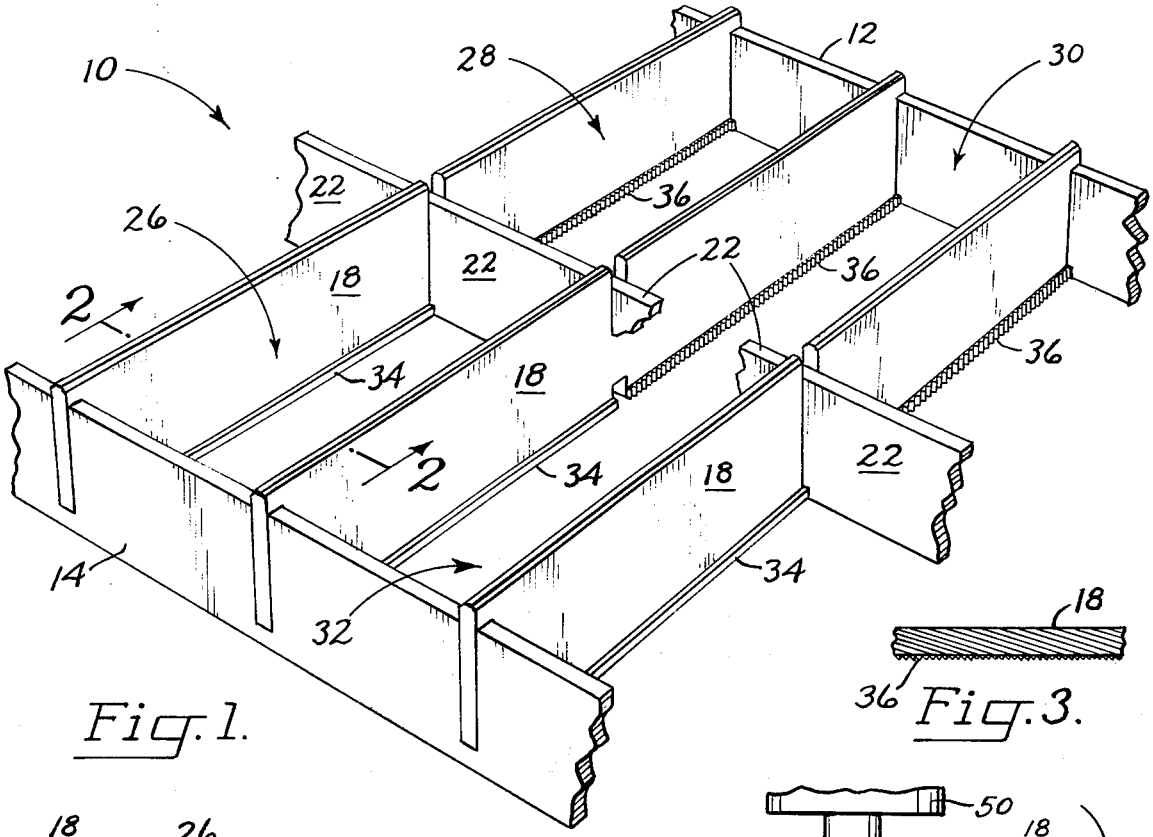
Fig. 1.
Fig. 3.
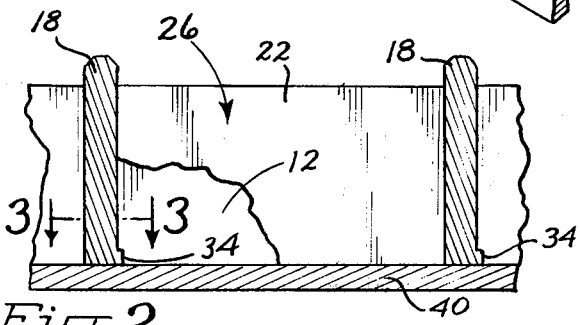
Fig. 2.
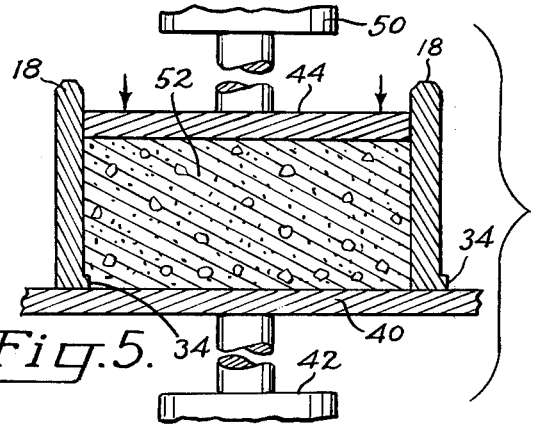
Fig. 5.
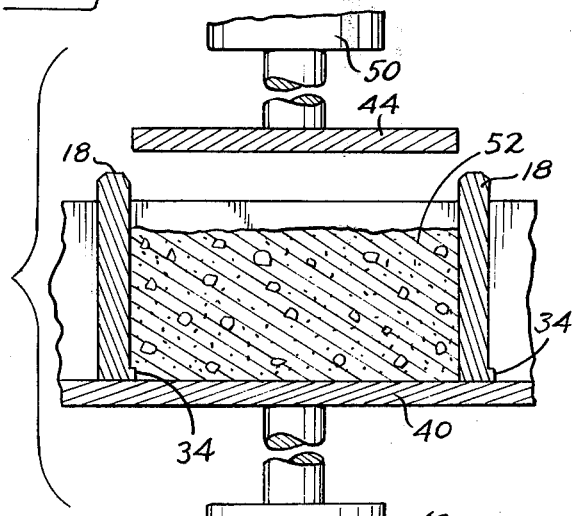
Fig. 4.
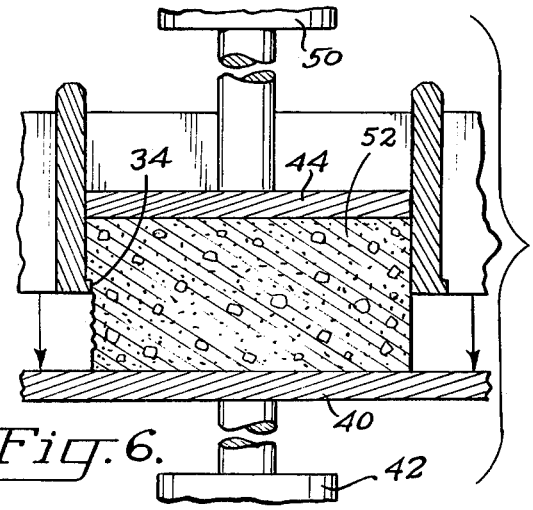
Fig. 6.

APPARATUS FOR MANUFACTURING ROUGH FACED BRICKS

BACKGROUND AND SUMMARY OF THE INVENTION

This invention relates to brick-molding apparatus, and more particularly to such apparatus which is operable to produce a brick with a roughened face.

For aesthetic and other reasons, it often is desired to produce bricks, or blocks, having irregularly roughened surfaces. To manufacture roughened bricks, or blocks, of concrete, it has generally been necessary in the past to form a block which is a whole number multiple of the size required and then break it along a plane extending normal to one of its sides to provide multiple blocks having irregularly roughened sides. In such previous methods those sides which previously had been joined along opposite sides of the cleavage line become the roughened surfaces of the blocks.

Others have attempted to roughen the surfaces of blocks by providing projecting teeth which extend at substantially less than a 90° angle to the path of movement of a side of the brick, which projections were to form grooves in a surface of the block. These previous devices have proved unsatisfactory in that, for the most part, very regular lines are formed in the surface of the brick, rather than the desired irregularly roughened surface.

A general object of the present invention is to provide novel apparatus operable to form bricks, or blocks, having an irregularly, roughened surface along at least one of its sides.

More specifically, an object of the present invention is to provide novel apparatus which is operable to produce an irregularly roughened surface on a brick by providing a scraping, or tearing, of the surface of one side of the brick by a rigid member extending substantially normal to such face of the block as the member and block are moved relative to each other.

Still more specifically, an object is to provide a novel mold for a brick having interconnected side plates bounding a block-forming cavity for receiving block material. One of the side plates has a lip projecting outwardly from one of its edges substantially normal to the side. The mold is so constructed that a formed, uncured brick is discharged from the mold past said lip whereby the lip produces a tearing, or scraping, action along the face of brick adjacent thereto to produce a desired irregularly roughened effect.

Yet another object is to provide such novel apparatus which includes a bottom plate which is shiftable vertically relative to the side plates of the mold between a raised position adjacent the undersides of the side plates for forming a bottom of the mold and a position lowered a distance therebelow. Also included in such apparatus is a powered pusher above the mold operable to push down against the top of a brick formed in the mold for forcing it out through the bottom of the mold when the bottom plate is lowered. The bottom plate and pusher are mounted for movement vertically at substantially the same speed so that the bottom plate may continue to provide underlying support for an uncured brick as it is forced out of the bottom of the mold by operation of the pusher. This permits the brick to be forced past the projecting lip on a side plate to provide the required force for scraping, or tearing, the surface for roughening.

BRIEF DESCRIPTION OF THE DRAWINGS

These and other objects and advantages will become more fully apparent as the following description is read in conjunction with the drawings, wherein:

FIG. 1 is a perspective view of portions of brick, or block, molding apparatus according to the invention;

FIG. 2 is a cross-sectional view taken generally along the line 2—2 in FIG. 1;

FIG. 3 is a view of a portion of a side plate taken generally along the line 3—3 in FIG. 2; and FIGS. 4, 5 and 6 are sequential cross-sectional views of the apparatus at different stages of operation for forming a rough-faced brick.

DETAILED DESCRIPTION OF AN EMBODIMENT OF THE INVENTION

Referring to the drawings, and first more specifically to FIG. 1, at 10 is indicated generally a multiple-cavity mold for forming bricks, or blocks. The mold includes a pair of laterally spaced, substantially parallel, elongate, upright side plates 12, 14. A plurality of laterally spaced, substantially parallel, upright, elongate divider, or side, plates 18 extend between and are connected adjacent their opposite sets of ends to side plates 12, 14.

Axially aligned in a row midway between side plates 12, 14 are a plurality of upright plates 22 which extend between and are connected adjacent their opposite sets of ends to opposed divider plates 18.

Referring to FIG. 2, it will be seen that plates 12, 14, 18 and 22 are so connected that their lower marginal edges are all disposed in a substantially common horizontal plane. All of such upright plates are referred to herein as side plates, and they define between them a plurality of brick-forming cavities indicated generally at 26, 28, 30, 32. Each of such cavities, when viewed from above, has substantially the outline, or shape, of a brick which is to be formed by such molds.

In each of such cavities, and referring specifically to cavity 26, the upper marginal edge portions of plates 14, 22, and 18 bound an opening in the top of the mold and the lower marginal edges of these plates bound an opening in the bottom of the mold.

As is best seen in FIGS. 1, 2 and 3, plates 18 have elongate lips 34, 36 thereon extending adjacent and substantially parallel to lower marginal edges of plates 18. The lips on a plate project substantially normally outwardly from a planar face of the plate into the mold cavity with which the plate is associated.

Lip 34 on a plate 18 has a substantially constant rectangular cross section extending fully across its portion of the plate. The edge margin of lip 36 facing outwardly and away from the face of the plate is serrated, forming sawtooth-like projections extending outwardly from the plate. It has been found that in working with concrete to form bricks and blocks, it is preferable if lips 34, 36 project outwardly from the face of the divider plates a distance less than 0.15 inch.

Mounted adjacent the lower marginal edges of the plates forming the mold cavity is a substantially planar, horizontal bottom plate 40 (see FIGS. 4, 5 and 6). Plate 40 is connected, through suitable connecting means, to the rod end of an extensible-contractible upright ram 42. The ram mounts the bottom plate for vertical shifting between a raised position, as illustrated in FIGS. 4 and 5, held against the lower marginal edges of the side plates to form a bottom for the mold and a lowered position spaced therebelow as illustrated in FIG. 6.

Mounted above each of the mold cavities is a substantially horizontal, planar pusher plate, or element, 44. Pusher plate 44 has a substantially rectangular outline of such dimensions as to be able to fit slidably within a mold cavity. Plate 44 is connected, through suitable connecting means, to the rod end of an upright extensible-contractible ram 50.

Extension of the ram 50 is operable to shift plate 44 vertically under power between a raised position as shown in FIG. 4, spaced a distance above the mold cavity, downwardly to enter the top opening of the mold cavity as illustrated in FIG. 5. Further extension of ram 50 moves plate 44 fully through the mold cavity to the bottom of the cavity.

Explaining the operation of the apparatus, and referring initially to FIG. 4, with bottom plate 40 held against the underside of the mold-forming side plates 12, 14, 18 and 22, flowable brick-forming material, such as concrete, is poured into a cavity as indicated at 52. Ram 50 is then extended to lower pusher plate 44 against the top of the mass of concrete to compact the concrete and positively form a flat top surface for the mass of concrete in the mold (see FIG. 5).

Referring to FIG. 6, after top plate 44 has been lowered into the mold cavity to compact the mass of concrete therein to conform it to the shape of the cavity, ram 50 is extended and ram 42 is contracted concurrently, with both moving at substantially the same speed. This produces concurrent lowering of plates 40, 44 relative to mold plates 12, 14, 18 and 22. As this occurs, top plate 44 forces the formed brick through the bottom opening of the mold with plate 40 maintaining support on the underside of the brick.

It should be realized that although the concrete is in an uncured state when it is discharged from the mold it is sufficiently set to maintain its general brick-shaped configuration. As the uncured block is forced from the mold, lips 34 or 36 projecting normally into the path of a side of the brick produces a scraping, or tearing, action on the surface of the brick to produce an irregularly roughened surface for that side of the brick.

It has been found that the serrated, or sawtoothed, projections of lips 36 while producing an irregularly roughened surface for the brick do not produce as coarse, or rough, a face as does lip 34.

While a preferred embodiment of the invention has been described herein, it should be apparent to those skilled in the art that variations and modifications are possible without departing from the spirit of the invention.

It is claimed and desired to secure by Letters Patent:

1. Apparatus for manufacturing a brick having a roughened side surface, said apparatus comprising a mold including a plurality of interconnected side plates defining a cavity therebetween having substantially the shape of a brick to be formed and adapted to receive material for molding into brick shape, said side plates having a set of edge margins defining an opening therebetween through which a formed uncured brick may be discharged from the mold, one of said side plates having an elongate lip rigidly secured thereon adjacent said opening, said lip extending substantially parallel to said edge margin of the plate and projecting substantially normally into the path along which a side of a brick moves on being discharged from said mold operable to tear a portion of the material forming said brick from the surface of the brick as it is discharged from the mold to produce an irregularly roughened surface for said brick.

2. The apparatus of claim 1, wherein the path along which the brick moves on being discharged from said mold is substantially parallel to the side plate having said lip and said lip projects substantially normally outwardly from said side plate.

3. The apparatus of claim 1, wherein said lip projects outwardly from its associated side plate a distance less than 0.15 inch.

4. The apparatus of claim 1, which further comprises powered means operable to engage a formed, uncured brick in said mold on a side of the brick opposite said opening and to force said brick through said opening to discharge it from the mold.

5. The apparatus of claim 1, wherein said side plates are disposed substantially upright in the mold with upper marginal edge portions of said side plates bounding an opening in the top of the mold and lower marginal edge portions of said side plates bounding an opening in the bottom of the mold, said lip on a side plate being disposed adjacent the lower marginal edge of its associated plate, and which further comprises a substantially horizontal bottom plate mounted for vertical movement toward and away from said lower marginal edge portions of the side plates between a raised position contiguous the lower edge portion of said side plates and a lowered position spaced a distance therebelow, and a power-operated, vertically shiftable pusher mounted for powered vertical movement from a position spaced above said mold to a position in said mold for forcing a brick through said bottom opening in the mold when said bottom plate is lowered.

6. The apparatus of claim 5, which further comprises means for lowering said bottom plate at substantially the same speed at which said pusher is moved into said mold.

7. The apparatus of claim 1, wherein said lip is serrated along an edge thereof facing outwardly from said one side plate.

* * * * *